United States Patent [19]

Köbler

[11] Patent Number: 4,893,534

[45] Date of Patent: Jan. 16, 1990

[54] COMBINATION WEB CUTTING AND PATH SWITCHING SYSTEM

[75] Inventor: Ingo Köbler, Anhausen, Fed. Rep. of Germany

[73] Assignee: Man Roland Druckmaschinen AG, Fed. Rep. of Germany

[21] Appl. No.: 207,145

[22] Filed: Jun. 15, 1988

[30] Foreign Application Priority Data

Jun. 30, 1987 [DE] Fed. Rep. of Germany ..... 3721515

[51] Int. Cl.[4] ..... B26D 1/40; B65H 35/08

[52] U.S. Cl. ..... 83/107; 83/102; 83/155; 83/346

[58] Field of Search ..... 83/102, 105, 106, 107, 83/151, 154, 155, 161, 322, 323, 343, 346, 347, 348

[56] References Cited

U.S. PATENT DOCUMENTS

| | | | |
|---|---|---|---|
| 2,027,412 | 1/1936 | Zuckerman | 83/322 |
| 4,373,713 | 2/1983 | Loebach | 271/303 |
| 4,538,800 | 9/1985 | Richter | 271/120 |
| 4,811,641 | 3/1989 | Muller | 83/105 |

*Primary Examiner*—Hien H. Phan

*Attorney, Agent, or Firm*—Frishauf, Holtz, Goodman & Woodward

[57] ABSTRACT

A cutter cylinder-counter cylinder combination pair (5, 6) has cutter knives (13, 14) and counter elements (15, 16) thereon, respectively, preferably, located diametrically opposite each other. A cutter knife (14) on one cylinder (6) cooperates with a counter element (15) on the other cylinder (5). In addition to the cutter knives and counter elements, the cylinders carry deflection elements which are positioned relative to the direction of rotation of the cylinders behind the cutter knives for deflection of the leading edge of the web (2) into one of two selected paths (18, 19; 20, 21). The deflection elements include a longer and comparatively stiff, elastic blade (11) on one cylinder and a short, and more flexible blade (10) on the other cylinder. The two elements cooperate to grip the web (2) between themselves and, upon rotation of the cylinders, the stiffer, longer blade deflects the edge (26) of the web into the given path, permitting the shorter, resilient blade to flex. After the sheet is deflected into the respective path, and for example after having been gripped by the path transport system, for example belts, it is cut by the cutter knife engaging the cooperating cutter element of the cylinders upon continued rotation, the deflection elements gripping, anew, the web just behind the cut edge.

16 Claims, 2 Drawing Sheets

COMBINATION WEB CUTTING AND PATH SWITCHING SYSTEM

Reference to related application, assigned to the assignee of the present invention, the disclosure of which is hereby incorporated by reference: U.S. Ser. No. 07,207,146, filed June 15, 1988, KOBLER.

Reference to related U.S. Pat. No. 4,373,713.

The present invention generally relates to paper handling apparatus, and more particularly cutting a continuously supplied web of paper and then distributing the cut sheets into two different paths for removal.

BACKGROUND

It has previously been proposed, see U.S. Pat. No. 4,373,713, to subdivide cut sheets which are cut from a continuous substrate web. The substrate web is supplied to a rotating cylinder pair by continuously operating transport means, such as transport belts. Deflection tongues are located behind the cylinder pair. Each cylinder of the cylinder pair has a segment which projects out of the circumferential surface of the cylinder into the selected transport path for the printed substrate. The circumferential position of the segments, and the speed of the cylinder pairs, with respect to the speed and position of the received web, are so synchronized or related to each other that the segment of one cylinder guides the substrate beneath a fixed deflection tongue and then into a first transport path, while the segment of the other cylinder guides the substrate over the deflection into a second transport path.

The sheets which are supplied are already severed from a web, so that an additional cutter element must be provided in order to cut the sheets from a continuous substrate. This increases the size of the apparatus.

THE INVENTION

It is an object to provide a combination cutter and path switching or selection apparatus, which is compact and permits severing the web into cut sheets and, additionally, carrying out the distribution or switching function to switch the then cut sheets into respectively different transport paths.

Briefly, a cutter cylinder - counter cylinder combination pair is provided on which cutter knives and counter elements, respectively, are located; preferably, each cylinder carries a cutter knife and, diametrically opposite, a counter element, to cooperate, respectively, with a counter element and a cutter knife on the other cylinder. In addition to the cutter knife and counter element or counter strip or blade, the cylinders carry deflection elements which are positioned, relative to the direction of rotation, in advance of the cutter knife, for deflection of the web in one of the selected paths before the web is severed by the cutter knife of the cutter cylinder - counter cylinder pair.

In accordance with a preferred feature of the invention, the deflection elements are located, in the direction of rotation of the cylinders, just behind the respective cutter knives and counter elements or counter blades the grip the leading edge of a web which has just been severed; the deflection elements are resilient, and one of them is longer than the other so that the gripped leading edge of the web is directed to the respective path, the web then being subsequently severed as it is pulled between the nip of the two cutter cylinder - counter cylinder pairs and meets the subsequently arriving cutter blade or knife engaging the respective counter blade or strip.

The system has the advantage that the cutter knife - counter element cylinder combination simultaneously carries out the distribution and severing function, thus resulting in a compact arrangement.

DRAWINGS

FIG. 1 is a highly schematic side view of the system in accordance with the present invention in a first working position; and FIG. 2 is an illustration similar to FIG. 1 in which the cylinders have rotated by about 45° with respect to the illustration of FIG. 1.

DETAILED DESCRIPTION

Figure 1:
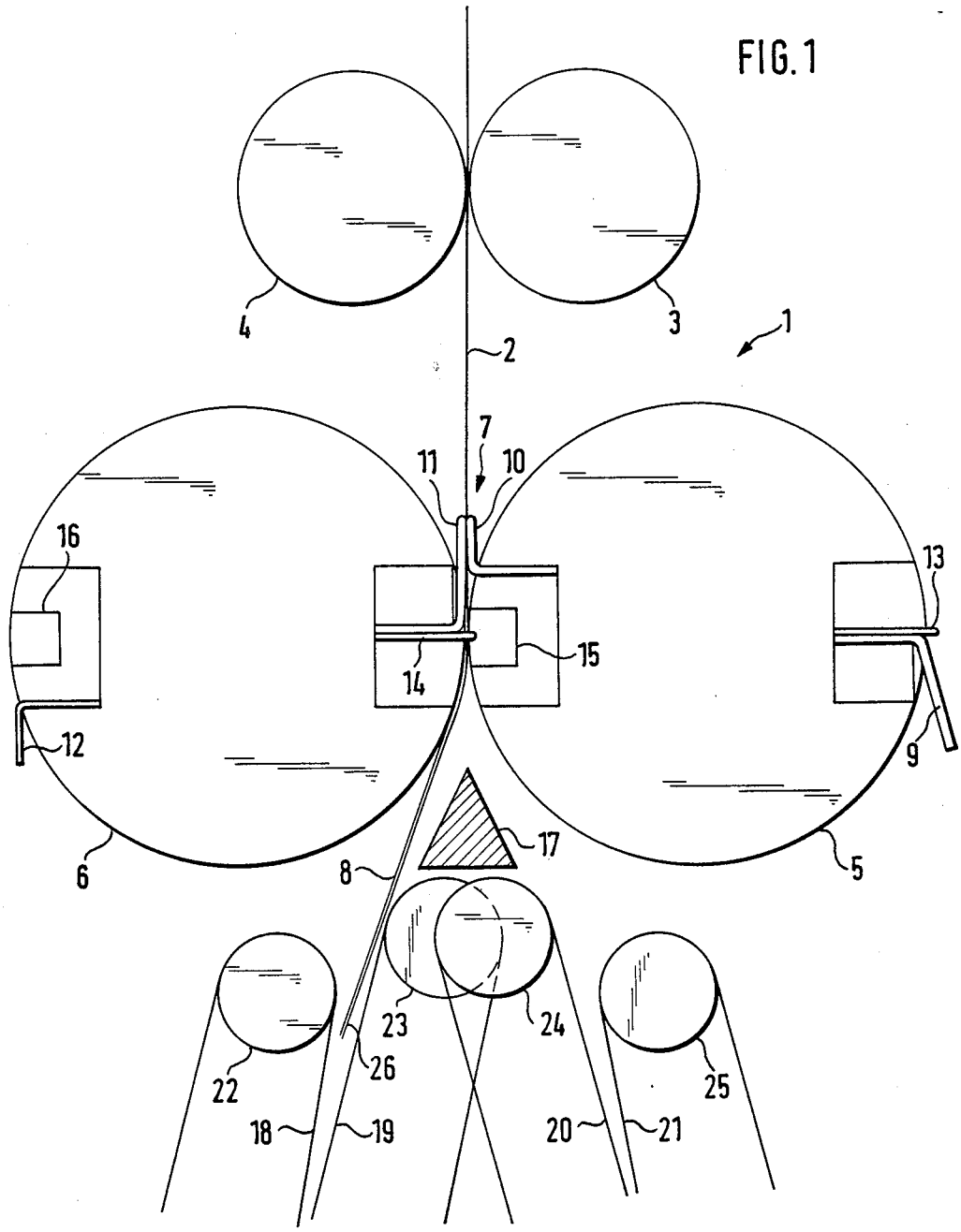

The system is intended to sever a substrate web 2, typically a printed paper web, which is delivered in preferably vertical direction between two pull-off or delivery rollers 3, 4, typically driven, from a paper handling apparatus, for example a printing machine. Two cooperating, engaged cylinders 5, 6 are positioned to receive the web 2 and cut the web at a nip position 7 to form cut sheets 8. The cut sheets 8 are alternately directed into one of two transport paths.

Each one of the cutter cylinder - counter cylinder pairs 5, 6 carries a cutter blade or knife 13, 14, respectively, and a counter blade or counter strip or element 15, 16. Upon engagement of a knife 14 with a counter blade 15, for example, see FIG. 1, the web 2 is severed to form a sheet 8. Of course, more than two such knife - blade combinations can be used.

In accordance with a feature of the invention, directing elements 9, 10 and 11, 12 are located on the respective cylinders 5, 6. These directing elements are in the form of vanes or wings. They function as deflection elements to deflect the leading edge of the web 2 into one of two respective transport paths. Preferably, a directing tongue 17, with essentially triangular cross section, is located in line with the nip between the cylinders 5, 6, positioned essentially in advance of the respective transport path.

The left transport path is formed by a pair of belts 18, 19; the right transport path is formed by a pair of belts 20, 21. The respective belts are directed in their transport path position, essentially in engagement with each other, by suitable deflection and guide rollers 22, 23, 24, 25. The belts are shown separated from each other for ease of illustration, although they are arranged to grip the respective leading edge of the web and subsequently cut sheets 8.

OPERATION

Figure 2:
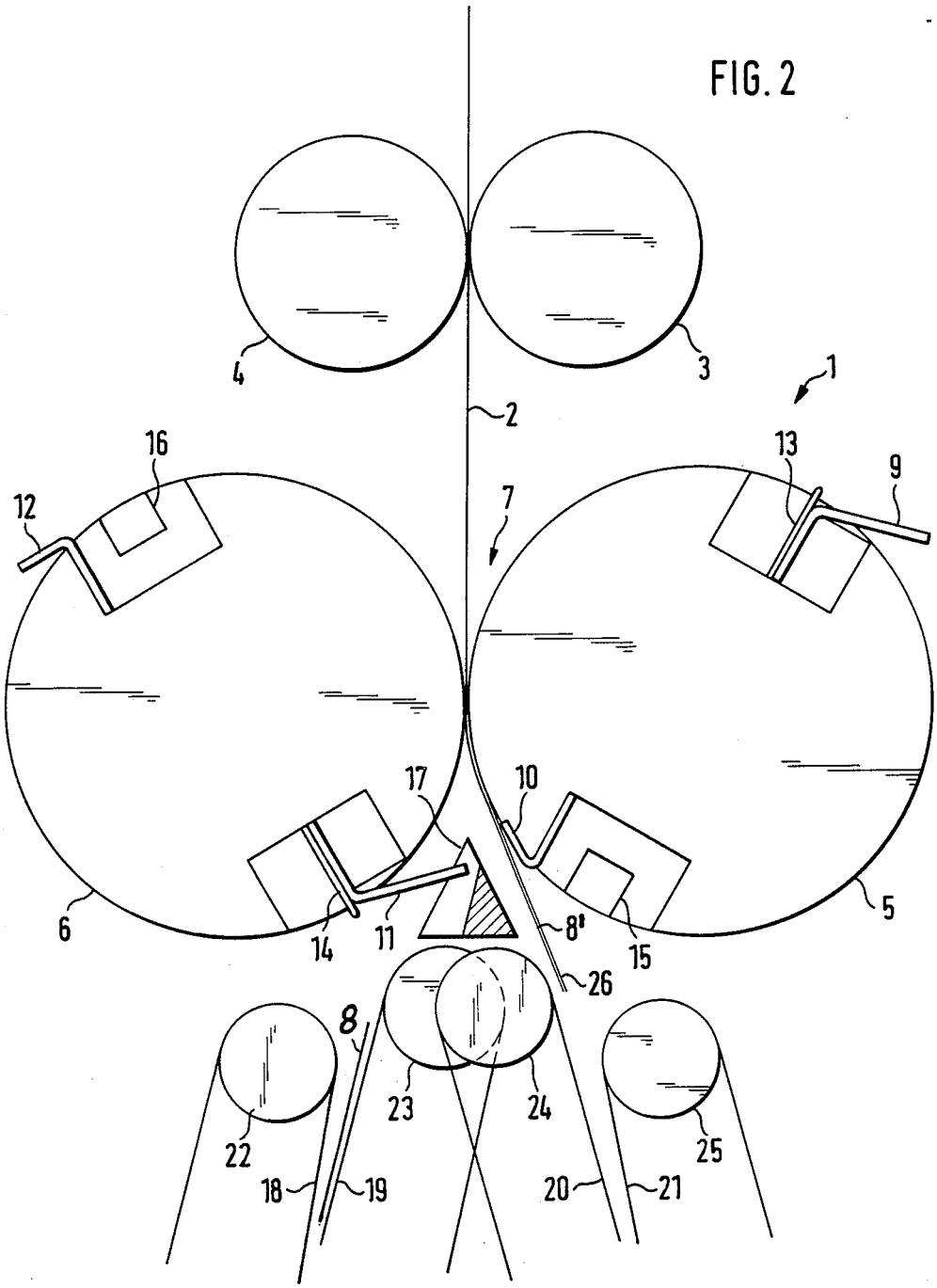

The leading edge 26 of the web 2 is directed by the deflection element pair 9, 10 into the selected transport path, for example the path between the belts 18, 19. FIG. 1 illustrates the position in which the sheet 8 has been directed in the respective transport path and is being engaged by the transport belts 18, 19, shown separated merely for illustration. FIG. 2 illustrates the situation after the cylinders 5, 6 have rotated somewhat. The leading edge 26 of the web 2 has been directed by the deflection element pair 10, 11 towards the right transport path formed by belts 20, 21 to form, after severing by the knife 13 cooperating with the counter element 16, the subsequently formed cut sheet 8'.

The alternate insertion of the sheets 8 into one or the other transport path 18, 19 or 20, 21 is obtained by making one of the deflection vanes or wings or deflection elements stiffer than the other. Considering the position of FIG. 1, the longer one of the wings 11, cooperating with the shorter wing 10, is stiffer than the shorter wing. Initially, and as the cylinders rotate towards each other, the two wings or vanes 10, 11 will grip the web 2, as shown in FIG. 1. Upon continued rotation, the longer wing 11, which is stiffer than the wing 10, deflects the web 2 towards the right, see FIG. 2, as the cylinders rotate. As soon as the leading edge 26 of the web is gripped by the transport belts 20, 21, the subsequently formed sheet 8' can be severed from the web 2 by the knife 13. Of course, upon rotation about 180°, the system will operate in reverse direction towards the left transport path 18, 19. As best seen in FIG. 2, the cooperating of the wings or vanes 11 and 10, in which the shorter vane 10 is more resilient than the longer wing 11, the initial or leading portion 26 of the web is placed into the respective transport path to permit subsequent cutting of the web and form the respective sheet elements 8 and 8'.

The cooperation of a stiffer or longer, respectively, wing or vane or deflection element 9 with a more resilient, or respectively shorter wing 12 and, upon continued rotation, of a longer and less resilient element 11 with a shorter and more resilient element 10, permits alternate feed of the leading edge 26 of the web into the respective transport path 20, 21 or 18, 19. Of course, by suitable relocation of the respective wings, for example by placing only long wings on one cylinder and only short wings on the other, all sheets can be directed to one of the paths; or, by placing a plurality of differently shaped wings on the respective cylinders, different distribution of the cut sheets 8, 8' in the respective paths can be obtained.

The wings 9, 10, 11, 12 can all be made of the same material, and basically having the same stiffness. The respective elasticity can be obtained solely by the shape or form, or dimensioning of the respective wings. Alternatively, different materials or differently treated or processed materials can be used for the respective longer wings 9, 11 and the shorter wings 10, 12, arranged such that in any case a stiffer wing is pressed against a more resilient one. The more resilient wing, in the example the wings 10, 12, lifts the substrate portion before being cut off the respective cylinder, as seen for example in FIG. 2, the less resilient and in the example shown longer wing 11 directing the leading edge 26 into the respective transport path.

The wedge 17 can be formed with a relief for passage of the wing 17, as shown in FIG. 2, with the respective wings 9, 10 axially offset with respect to each other.

I claim:

1. Combination web cutting and path switching system for web substrates (2), such as printed paper webs, having means (3, 4) for supplying the web (2) to the system, the system comprising a cutter cylinder and counter cylinder pair (5, 6) having a plurality of cutter knives;

two removal paths (18, 19; 20, 21) located essentially symmetrically with respect to the nip of the cylinder pair, and comprising, in accordance with the invention, elastic deflection elements (9, 10; 11, 12) located on the cutter cylinder and counter cylinder pair (5, 6), said deflection elements being positioned relative to the direction of rotation, behind one of the plurality of cutter knives, for deflection of the leading edge of the web into one of the removal paths (18, 19; 20, 21) before the web is severed by one of the plurality of cutter knives of the cylinder and counter cylinder pair (5, 6).

2. The system of claim 1, wherein each cylinder has one of said cutter knives and a counter element, the cutter knives and counter elements of each cylinder being located diametrically opposite to each other.

3. The system of claim 2, wherein the deflection elements comprise cooperating pairs of vanes or wings, and each one of the cylinders has, diametrically opposite to each vane or wing, one of said deflection vanes or wings of different characteristics.

4. The system of claim 3, wherein said different characteristics being the lengths of the respective vanes or wings.

5. The system of claim 3, wherein the different characteristics being the degrees of elasticity of the respective vanes or wings.

6. The system of claim 3, wherein said different characteristics are the length and stiffness of the vanes or wings.

7. The system of claim 3, wherein one of said deflection vanes or wings is located, relative to the direction of rotation of said cylinders, closely behind the cutter knife of one of said cylinders;

and wherein the cooperating vane or wing of the other of said cylinders is located circumferentially offset from the vane or wing located just behind the cutter knife on the other of said cylinders, one of said vanes or wings of one of said cylinders having a portion in mutual alignment with one of said vanes or wings of the other of said cylinders when one of said cutter knives engages the cooperating counter element of the other of said cylinders for gripping said web between said vanes or wings.

8. The system of claim 7, wherein said vanes or wings located close to the cutter knife of one of said cylinders are longer than the cooperating vane or wing on the other one of said other cylinders.

9. The system of claim 8, wherein the longer vanes or wings are stiffer than the shorter, cooperating vanes or wings.

10. The system of claim 1, wherein the cutter cylinder has one of said cutter knives (13, 14) and the counter cylinder has a counter element (15, 16) cooperating, respectively, with the cutter knife;

and wherein at least one of the deflection elements (9, 11) is positioned, relative to the direction of rotation, closely behind the respective one of said cutter knives for gripping the web adjacent a newly formed leading edge (26) thereof upon severing of the web by the respective one of said cutter knives.

11. The system of claim 1, wherein the deflection elements comprise cooperating deflection vanes or wings, one vane (9, 11) on one of said cylinders being longer than a cooperating vane (10, 12) on the other of said cylinders.

12. The system of claim 1, wherein the deflection elements comprise cooperating pairs of elastic vanes or wings, one vane or wing of each pair (9, 11) being stiffer and less elastic than the cooperating vane or wing (10, 12).

13. The system of claim 12, wherein the stiffer or less elastic vane or wing (9, 11) is longer than the cooperating, more elastic vane or wing (10, 12).

14. The system of claim 1, wherein said web supply means guides the web (2) in an essentially vertical path; and wherein the removal paths (18, 19; 20, 21) comprise diverging belt transport means, located beneath said cutter cylinder - counter cylinder pair (5, 6).

15. The system of claim 1, further including a deflection tongue (17) located essentially symmetrically with respect to a nip formed between the cylinder pair.

16. The system of claim 15, wherein the deflection tongue has at least approximately a triangular cross section.

* * * * *